US011771152B2

(12) United States Patent
Flockton et al.

(10) Patent No.: US 11,771,152 B2
(45) Date of Patent: Oct. 3, 2023

(54) SWIMMING GARMENTS

(71) Applicant: SPEEDO INTERNATIONAL LIMITED, London (GB)

(72) Inventors: Karen Flockton, London (GB); Ben Hardman, Finchley (GB); Tim Sharpe, Finchley (GB); Joseph Santry, Finchley (GB)

(73) Assignee: SPEEDO INTERNATIONAL LIMITED, Greater London (GB)

( * ) Notice: Subject to any disclaimer, the term of this patent is extended or adjusted under 35 U.S.C. 154(b) by 953 days.

(21) Appl. No.: 15/504,623

(22) PCT Filed: Aug. 14, 2015

(86) PCT No.: PCT/GB2015/052367
§ 371 (c)(1),
(2) Date: Feb. 16, 2017

(87) PCT Pub. No.: WO2016/027071
PCT Pub. Date: Feb. 25, 2016

(65) Prior Publication Data

US 2017/0265536 A1 Sep. 21, 2017

(30) Foreign Application Priority Data

Aug. 22, 2014 (GB) ..... 1414942

(51) Int. Cl.
*A41D 7/00* (2006.01)
*A41D 13/012* (2006.01)
(Continued)

(52) U.S. Cl.
CPC ..... *A41D 13/012* (2013.01); *A41D 7/00* (2013.01); *A41D 27/245* (2013.01); *A41D 31/02* (2013.01); *A41D 2600/10* (2013.01)

(58) Field of Classification Search
CPC ..... A41D 13/012; A41D 7/00; A41D 27/245; A41D 31/02; A41D 31/185; A41D 13/005;
(Continued)

(56) References Cited

U.S. PATENT DOCUMENTS 3,771,169 A * 11/1973 Edmund ..... B63C 11/04 2/2.17
4,654,894 A * 4/1987 Kudo ..... A41D 7/00 2/67
(Continued)

FOREIGN PATENT DOCUMENTS

CN 201733900 2/2011
CN 202727423 2/2013
(Continued)

OTHER PUBLICATIONS

Chinese Second Office Action, Application No. 201580049713.X, dated Nov. 6, 2018, 25 pages.
(Continued)

*Primary Examiner* — Heather Mangine
(74) *Attorney, Agent, or Firm* — Stephen J. Weyer, Esq.; Stites & Harbison, PLLC

(57) ABSTRACT

A swimming garment formed from a stretchable elasticated fabric, wherein the garment comprises at least one sensitivity zone in which the fabric thickness is less than the fabric thickness of the region of the garment surrounding the sensitivity zone. The sensitivity zones can give a heightened sensation in a specific position of the body, for example in the abdominals. The thinner fabric zone increases the sensation of water flow/temperature which in-turn leads to a proprioceptive response to activate the muscle group beneath the zone.

12 Claims, 3 Drawing Sheets

(51) Int. Cl.
*A41D 27/24* (2006.01)
*A41D 31/02* (2019.01)

(58) Field of Classification Search
CPC ..... A41D 13/0015; A41D 13/0017; A41D 2400/38
See application file for complete search history.

(56) References Cited

U.S. PATENT DOCUMENTS 4,698,847 A * 10/1987 Yoshihara ..... A41C 1/06 2/69
4,946,453 A * 8/1990 Monson ..... A41D 31/18 604/312
4,956,878 A * 9/1990 Boynton ..... A41D 7/00 2/67
RE33,406 E * 10/1990 Wior ..... A41D 7/00 2/67
5,033,986 A * 7/1991 Feigenbaum ..... A41C 3/08 450/30
5,201,074 A * 4/1993 Dicker ..... A63B 21/0552 2/70
5,263,923 A * 11/1993 Fujimoto ..... A61F 13/10 602/62
5,515,542 A * 5/1996 Simmons ..... A41D 7/00 2/243.1
5,742,936 A 4/1998 Trone
5,745,917 A * 5/1998 Dicker ..... A63B 21/4001 2/69
5,809,567 A * 9/1998 Jacobs ..... A41D 31/18 2/1
5,819,322 A * 10/1998 Dicker ..... A63B 21/4017 2/456
5,839,122 A * 11/1998 Dicker ..... A63B 21/4013 2/67
5,888,118 A * 3/1999 Kishi ..... A41D 1/14 450/122
5,937,442 A * 8/1999 Yamaguchi ..... A41D 31/185 2/69
5,996,120 A * 12/1999 Balit ..... A41D 13/0017 2/67
6,279,161 B1 * 8/2001 Johnston ..... A41D 13/0015 2/69
6,339,845 B1 * 1/2002 Burns ..... A41D 31/102 2/243.1
6,446,264 B2 * 9/2002 Fairhurst ..... A41D 7/00 2/2.15
D586,081 S * 2/2009 Rance ..... D2/731
D586,082 S * 2/2009 Rance ..... D2/731
7,559,093 B2 * 7/2009 Sudo ..... A63B 21/4025 2/69
D601,778 S * 10/2009 Rance ..... D2/731
7,814,569 B2 10/2010 Di Lorenzo
7,886,367 B2 2/2011 Chapuis et al.
7,937,771 B2 * 5/2011 Mazzarolo ..... A41D 13/0015 2/69
7,992,218 B2 8/2011 O;Hara
8,196,220 B2 6/2012 Rance et al.
8,286,262 B2 10/2012 Rance et al.
8,533,864 B1 * 9/2013 Kostrzewski ..... A41D 31/185 2/69
8,561,212 B2 10/2013 Saotome
8,832,863 B2 * 9/2014 Yang ..... A41D 13/0015 2/69
8,850,619 B2 * 10/2014 Rush ..... A41D 1/089 2/228
8,856,964 B2 * 10/2014 Mather ..... A41D 13/0015 2/115
9,144,252 B1 * 9/2015 Kostrzewski ..... A41D 31/18
9,622,516 B2 * 4/2017 Lau ..... A41C 3/0014
9,642,401 B2 * 5/2017 Yamada ..... A41D 13/065
9,687,031 B2 * 6/2017 Turner ..... A41D 1/08
9,763,483 B2 9/2017 Waller et al.
9,790,625 B2 * 10/2017 Hussey ..... D03D 15/08
D806,358 S * 1/2018 Flockton ..... D2/731
9,854,853 B2 * 1/2018 Musciacchio ..... A41D 7/005
D809,245 S * 2/2018 Yeomans ..... D2/731
9,888,730 B2 * 2/2018 Spenser ..... A41D 7/00
9,936,755 B2 * 4/2018 Blakely ..... A41D 31/02
10,039,330 B2 * 8/2018 Tanaka ..... A41D 1/088
10,039,331 B2 * 8/2018 Vauge-Lalanne ..... A41D 1/082
D847,463 S * 5/2019 Flockton ..... D2/731
10,814,514 B2 * 10/2020 Aihara ..... A41D 27/285
10,905,175 B1 * 2/2021 DiLorenzo ..... A41D 7/00
2003/0028952 A1 * 2/2003 Fujii ..... A41C 1/003 2/400
2004/0255358 A1 * 12/2004 Ota ..... A41D 31/18 2/69
2005/0125872 A1 6/2005 Hobbs et al.
2005/0198722 A1 * 9/2005 Nordstrom ..... A41D 13/02 2/67
2007/0006356 A1 * 1/2007 Shiue ..... B63C 11/04 2/2.15
2007/0028362 A1 2/2007 Cash, Jr.
2007/0033696 A1 * 2/2007 Sellier ..... A41B 11/14 2/69
2007/0294797 A1 12/2007 Furgerson et al.
2008/0078008 A1 * 4/2008 Demarest ..... A41D 7/00 2/115
2008/0141430 A1 * 6/2008 Rance ..... A41D 7/00 2/67
2008/0256675 A1 * 10/2008 Di Lorenzo ..... A41D 7/00 2/67
2008/0295216 A1 * 12/2008 Nordstrom ..... A41B 11/003 2/69
2009/0038047 A1 * 2/2009 Di Lorenzo ..... A41D 7/005 2/67
2009/0113596 A1 * 5/2009 Young ..... A41D 13/0015 2/69
2010/0011479 A1 * 1/2010 Onoda ..... A41D 7/00 2/67
2010/0130903 A1 * 5/2010 Rock ..... D04B 1/243 602/62
2010/0205713 A1 * 8/2010 Takamoto ..... A41D 7/00 2/67
2012/0129425 A1 * 5/2012 Bevans ..... A41D 1/14 450/11
2013/0254971 A1 * 10/2013 Galluzzo ..... A41D 31/18 2/115
2013/0305425 A1 * 11/2013 Zarabi ..... A41D 1/06 2/69
2014/0090142 A1 4/2014 Waller et al.
2014/0096301 A1 4/2014 Waller et al.
2014/0338089 A1 11/2014 Brooks et al.
2017/0079339 A1 * 3/2017 Yeomans ..... A41D 27/06
2017/0245561 A1 * 8/2017 Flockton ..... A41D 7/00
2017/0265536 A1 * 9/2017 Flockton ..... A41D 27/245
2019/0045856 A1 * 2/2019 Musciacchio ..... A41D 31/185
2019/0090562 A1 * 3/2019 Moore ..... A41D 27/18

FOREIGN PATENT DOCUMENTS

CN 203137149 8/2013
CN 203137150 8/2013
CN 103462247 12/2013
CN 103637420 3/2014
DE 20 2006 012 273 1/2007
DE 20 2008 017 430 5/2010
FR 2 594 652 8/1987
GB 2 312 643 11/1997
GB 2 249 627 12/2008
GB 2 480 924 12/2011
GB 2 481 115 12/2011
GB 2 472 845 2/2013
JP 2007-314931 12/2007
JP JR 2009-161875 7/2009
JP 2010-281007 12/2010

(56) References Cited

FOREIGN PATENT DOCUMENTS

| | | |
|---|---|---|
| WO | WO 2009/015686 | 2/2009 |
| WO | WO 2016/027071 | 2/2016 |

OTHER PUBLICATIONS

Japanese Office Action, Japanese Patent Application No. 2017-510641, dated May 23, 2019, 7 pages.
International Search Report, International Application No. PCT/GB2015/0522367, International Filing Date: Aug. 14, 2015, 5 pages.
Written Opinion, International Application No. PCT/GB2015/052367, International Filing Date: Aug. 14, 2015, 6 pages.
Notification of Transmittal of the International Search Report and the Written Opinion of the International Searching Authority, or Declaration for PCT/GB2015/0522367, dated Oct. 23, 2015.
Japanese Office Action, Japanese Patent Application No. 2017-510641, dated Oct. 16, 2020.
Great Britain Search Report under Section 17(5), Application No. GB1414942.1, dated Feb. 20, 2015, 3 pages.
Great Britain Examination Report under Section 18(3), Application No. GB1414942.1, dated Mar. 7, 2017, 4 pages.

* cited by examiner

SWIMMING GARMENTS

TECHNICAL FIELD

The present invention relates generally to swimming garments, such as swimsuits, triathlon suits, waterpolo suits, wetsuits and other garments intended to be worn by a person when swimming. A preferred use is for swimsuits intended for competition swimmers.

BACKGROUND

Swimmers typically wear tight fitting garments which help decrease air/water resistance, which is especially important in competitive events. If maximum performance is to be achieved then it is also very important the the swimmer maintains a correct body position when executing a swimming stroke in the water. This requires coordinated firing of specific muscle groups depending on the stroke. Such body position, including the coordinated firing of muscle groups, is generally only learned and maintained through hours of training in a pool.

Swimming garments have been proposed that support a swimmer's core to help them maintain good body position in the water. For example, EP1935266 (Speedo) describes a swimsuit having increased support for a swimmer's core, provided by a double layer of fabric in a torso region of the suit that surrounds the swimmers abdomen and lumbar region.

SUMMARY OF THE INVENTION

It is a general aim of embodiments of the present invention to offer a swimming garment that better assists the swimmer to maintain a good body position, at least in part by encouraging activation of relevant muscle groups. In general terms, the approach proposed in embodiments of the invention is to provide a thinner fabric zone ('thinner' compared with adjacent regions of the garment) within the garment (for example a single layer fabric zone within a double fabric layer region of a garment) that, when the garment is worn, overlie muscle groups that it is wished to target. The thinner fabric zones result in a heightened sensation in the specific position of the body they register with, which in-turn leads to a proprioceptive response that encourages activation of the muscle group under the thinner fabric zone.

The invention provides a swimming garment formed from a stretchable elasticated fabric, wherein the garment comprises at least one sensitivity zone in which the fabric thickness is less than the fabric thickness of the region of the garment surrounding the sensitivity zone.

Typically, the thicker fabric region within which the sensitivity zone is formed will surround the sensitivity zone on all sides.

Some embodiments may include a plurality of sensitivity zones, wherein the fabric thickenss in each sensitivity zone is less than the fabric thickness of the surrounding region of the garment.

In some embodiments, a region of the garment containing one or more sensitivity zones is formed from at least two layers of fabric and each sensitivity zone is formed with one (or more) fewer layers of fabric than the region of the garment surrounding it. For example, a single layer sensitivity zone may be formed in a double layer region of the garment.

In some embodiments, one or more of the sensitivity zones are formed in single layer fabric regions of the garment by a localised thinning of the fabric. This thinning may be achieved for example during initial manufacture of the fabric (e.g. by circular knitting) or by a post-manufacture processing step (e.g. laser etching).

In embodiments of the invention, sensitvity regions can be formed in any of a number of appropriate locations, determined by the muscle or muscle groups that it is desired to act on. For example, one or more sensitivity zones can be formed in a region of the garment that, when the garment is worn, covers the abdomen of the wearer. These zones, may, for example, extend to overlie the upper abdominals and/or the lower abdominals.

Some embodiments include a pair of sensitivity zones in a region of the garment that covers the abdomen, the zones being spaced apart on opposite sides of the mid-line of the garment.

Other possible locations for the sensitivity zones, either in addition to or as an alternative to the abdomen, include over the glutes, which may be especially beneficial for male swimmers in order to maintain alignment of the legs during kicking, and on the inside of the thigh, which may be especially beneficial when swimming breaststroke.

The sensitivity zones can give a heightened sensation in a specific position of the body, for example in the abdominals. The thinner fabric zone increases the sensation of water flow/temperature which in-turn leads to a proprioceptive response to activate the muscle group beneath the zone. Where this is the abdominals, for example, it helps to maintain a good relative anterior positioning between pelvis and ribcage, leading to a more neutral pelvis and lumber spine position.

DETAILED DESCRIPTION

The invention will now be further described with reference to the following non-limiting Figures and Examples. Other embodiments of the invention will occur to those skilled in the art in the light of these.

Figure 1:
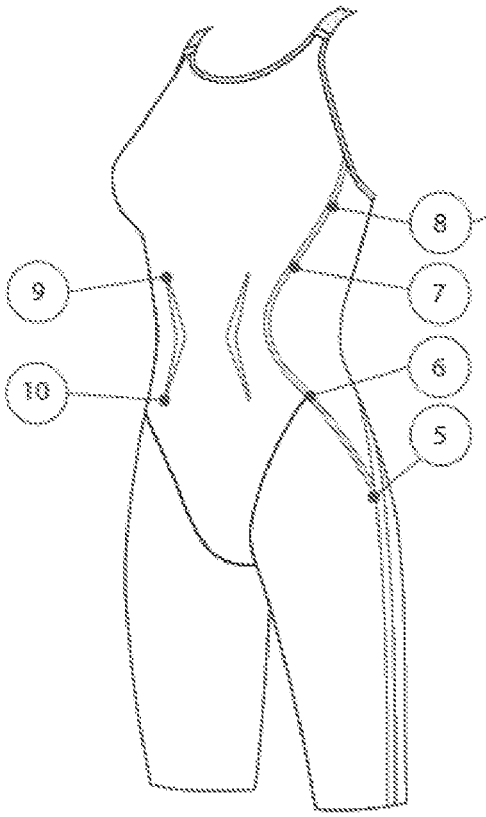
FIG. 1 shows a front perspective view of a swimsuit in accordance with an embodiment of the present invention.
Figure 2:
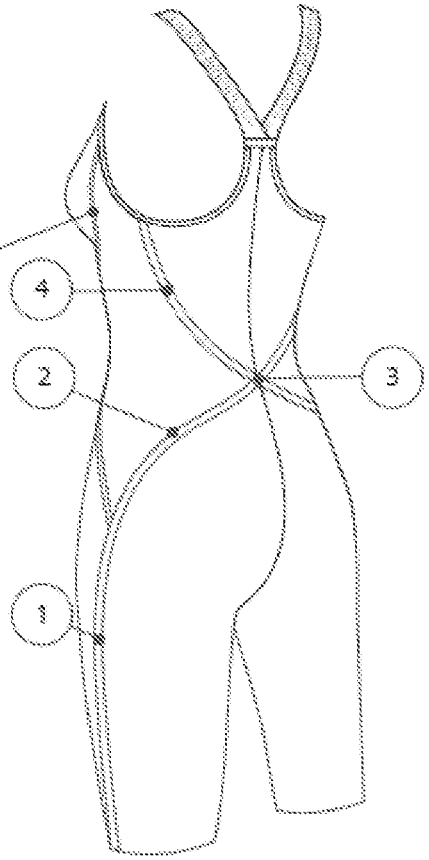
FIG. 2 shows a rear perspective view of the swimsuit of FIG. 1.

Referring to FIGS. 1 and 2, a swimsuit in accordance with a first exemplary embodiment of the invention is described. The swimsuit is a female suit intended for competitive swimming and is formed from a stretchable elasticated fabric of a type known for use in competition swimsuits.

In this example, the swimsuit is of a 'closed back kneeskin' type. As such, the suit includes left and right leg portions that extend down to the swimmer's knees and cover their thighs, a torso portion that covers the abdomen and the back (extending up to the bottom of the scapula) and a chest portion that covers the swimmer's chest. The suit has shoulder straps that extend from the top of the chest portion, at spaced apart points on each shoulder, over the shoulder to a central point at the top of the back portion, between the scapula. Arm openings are defined by the top edges of the chest and back portions in combination with the shoulder strap.

The swimsuit includes front and rear tension bands, which offer greater modulus (or resistance to stretch) along their length than the modulus of the basic stretchable elasticated fabric fabric of the suit. In this example, these tension bands are formed by bonded seams in the suit that join adjacent panels of the stretchable elasticated fabric fabric. The seams are taped on the inside of the suit.

More specifically, the rear tension bands are provided by crossed seam lines on the back of the suit that, when the suit is worn, follow the posterior oblique myofascial lines: the IT Band (1) into Glutes (2) on one side, across the Sacrum (3) to the opposite Latissimus dorsi (4) up into the shoulder on that opposite side. The two seam lines cross one another over the sacrum.

The front tension bands are provided by seam lines that, when viewed from the front, have a generally hour glass appearance to follow, when the suit is worn, skeletal landmarks and myofacial lines (muscle chains) to provide stability to the core region (upper and lower abdominals). These front seam lines connect to the rear seam lines at the greater trochanter (5), this being the point of rotation of the upper leg/thigh. The seam lines then run over the front of the pelvis at the anterior superior iliac spine (6) and then to the rib cage at the 5th/6th rib (7). The seam then follows the line of the pectorialis major (8) up to the the armhole of the suit.

In this example, in accordance with an embodiment of the invention, two features (referred to in the following as 'sensitivity zones') are formed on the front of the suit over the abdomen. In general terms, these sensitivity zones are areas in the suit that have a thinner fabric covering than surrounding areas of the suit to give a heightened sensation in a very specific position of the body, in this example the upper abdominals (9) and lower abdominals (10).

Figure 5:
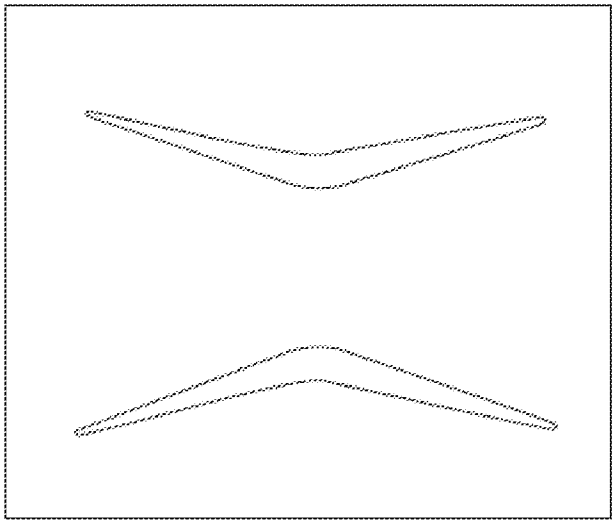
FIG. 5 shows, on an enlarged scale, a feature that is seen on the front of the swimsuits of FIGS. 1 and 3.

As seen in FIGS. 1 and 5, in this example there are two chevron-shaped sensitivity zones spaced apart one to either side of the midline of the front of the suit, with each pro hole extending from an upper region (9) of the abdominals to a lower region (10) of the abdominals.

In this example, the abdominal region of the suit is formed from two (or more) layers of fabric (e.g. two stretchable elasticated fabric fabric layers) and the sensitivity zones are created to provide the desired heightened sensation by removing one layer of fabric to increase the sensation of water flow/temperature which in-turn leads to a proprioceptive response in order to activate this muscle group and maintain a good relative anterior positioning between pelvis and ribcage. This leads to a more neutral pelvis and lumber spine position.

In other examples, to avoid using a double layer fabric region, the thinner areas of fabric to form the sensitivity zones can be produced by processing a fabric panel to produce localised thinning. For example, laser-etching of the surface layer of a fabric can create a localised thinner area within the fabric panel.

Alternatively, the fabric could be formed in the first instance with regions of differing thickness in order to provide the sensitivity zones. For example, a circular knitting process could be used to produce a 3D fabric panel (i.e. a panel with variation in thickness) or even a semi-complete suit. This production technique can produce a garment panel with thicker and thinner areas by design rather than using a secondary process to thin areas of the fabric.

The seam lines and sensitivity zones in the front of the suit are to give proprioceptive feedback to the lower abdominal region to initiate a more posterior pelvic tilt to help maintain a more neutral lumbar spine position ("flat lower back") and avoid excessive anterior pelvic tilt which can cause lumbar lordosis (extension). The cross seam lines on the back of the suit aim to connect the Gluteals and posterior chain muscles with the muscles on the back of the opposite shoulder, following the lines of the posterior oblique myofascial lines (IT Band into Glutes on one side, across the sacrum to the opposite Latissimus dorsi up into the shoulder on that side). This helps with proprioceptive feedback to fire the gluteal muscles to help maintain pelvic position (more posteriorly tilted into neutral and neutral lumbar spine) and also maintain good scapula position (slightly posteriorly rotated, retracted and depressed flat against the posterior chest wall) while initiating the scapula stabilising muscles (Serratus anterior, lower fibres trapezius mainly).

Thus it can be seen that in this example, the front and rear seams/sensitivity zones play slightly different roles. The seams in the front of the suit give purely proprioceptive feedback to the abdominal region to maintain a good pelvic position and a flat lower back. The crossed seams in the rear follow the posterior oblique myofascial lines to give proprioceptive feedback to connect this group of muscles. This then helps the glutes to fire and in turn maintain the good pelvic position (as with the front seams). By encouraging firing of the glutes in time with the opposite shoulder, the crossed seams on the back can also help with dynamic co-ordination and timing between upper and lower body (arms and legs).

Figures 3, 4:
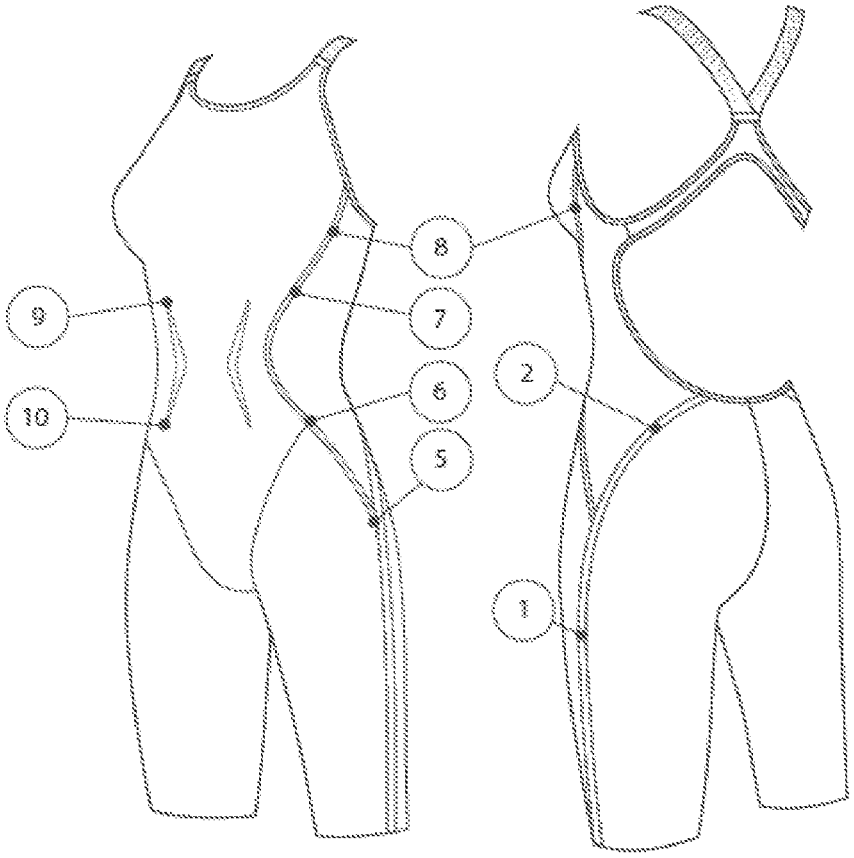
FIG. 3 shows a front perspective view of another swimsuit in accordance with an embodiment of the present invention.
FIG. 4 shows a rear perspective view of the swimsuit of FIG. 3.

FIGS. 3 and 4, show a second exemplary swimsuit in accordance with an embodiment of the invention. The suit of this example is very similar to the suit of FIGS. 1 and 2, save that in this example, the swimsuit is of an 'open back kneeskin' type. As such, it has an open back region (i.e. a region free of fabric) above the top of the glutes. The rear of the shoulder straps has a cross-like form with strap portions extending laterally and downwardly from the centre of the back between the scapula to join with the side of the chest portion of the suit. Consequently, the seams forming the rear tension bands terminate at the top of the glutes where they meet the back opening.

In other respects the example of FIGS. 3 and 4 is identical to the example of FIGS. 1 and 2, including the sensitivity zones on the abdomen and similar proprioceptive effects are obtained, although in this suit there is not the same connection between the sacrum and the latimmus dorsi. There is, however, still a benefit in connecting the IT bands to the sacro-illiac joints.

The skilled person will appreciate that the swimsuits illustrated in the Figures and described above are examples embodying inventive concepts described herein and that many and various modifications can be made without departing from the invention. For example, the same concepts can be applied to other types of swimming garment, such as triathlon suits, waterpolo suits and wetsuits for example. It is also possible to include 'sensitivity zones' and/or tension bands in alternative or additional positions on the garment to provide different or additional proprioceptive effects.

The invention claimed is:

1. A swimming garment formed from a stretchable elasticated fabric, wherein the garment comprises a pair of sensitivity zones, a thickness of the fabric in each sensitivity zone of the pair of sensitivity zones being less than a thickness of the fabric of a surrounding region of the garment that completely surrounds and directly borders each sensitivity zone of the pair of sensitivity zone, wherein the pair of sensitivity zones are spaced apart on opposite sides of a midline of the garment, and an entirety of each sensitivity zone of the pair of sensitivity zones is formed on a front of the swimming garment covering a front of a wearer when worn.

2. The swimming garment according to claim 1, wherein the surrounding region of each of the pair of sensitivity zones is formed from a double layer of the fabric and each sensitivity zone of the pair of sensitivity zones has a single layer of the fabric.

3. The swimming garment according to claim 1, wherein the stretchable elasticated fabric is configured to cover at least part of the wearer's hips, glutes, abdomen and chest, the garment including at least two tension bands that have a higher modulus of elasticity than adjacent regions of the stretchable elasticated fabric so that, in use, the tension bands offer greater resistance to stretch than the adjacent regions, wherein:

one of said tension bands follows a path from a left hip region of the garment onto a front of the garment over an upper left pelvis region of the garment to a left rib-cage region of the garment and then across a left lateral chest region of the garment back towards a left side of the garment adjacent a left arm opening in the garment; and another of said tension bands follows a path from a right hip region of the garment onto the front of the garment over an upper right pelvis region of the garment to a right rib-cage region of the garment and then across a right lateral chest region of the garment back towards a right side of the garment adjacent a right arm opening in the garment.

4. A swimming garment formed from a stretchable elasticated fabric, wherein the garment comprises at least one sensitivity zone in which a thickness of the fabric is less than a thickness of the fabric of a surrounding region of the garment which completely surrounds and directly borders the at least one sensitivity zone, wherein the at least one said sensitivity zone is configured to extend to overlie upper abdominals and lower abdominals of a wearer, and an entirety of the at least one sensitivity zone is formed on a front of the swimming garment covering a front of the wearer when worn, wherein the at least one sensitivity zone comprises a pair of sensitivity zones surrounded by said region of the garment, wherein said pair of sensitivity zones are spaced apart on opposite sides of a mid-line of the garment.

5. A swimming garment formed from a stretchable elasticated fabric, wherein the garment comprises at least one sensitivity zone in which a thickness of the fabric is less than a thickness of the fabric of a region of the garment which completely surrounds the at least one sensitivity zone, wherein, in use, the stretchable elasticated fabric is configured to cover at least part of a wearer's thighs, hips and glutes, the garment including at least two tension bands that have a higher modulus of elasticity than adjacent regions of the stretchable elasticated fabric so that, in use, the tension bands offer greater resistance to stretch than the adjacent regions;

wherein a first one of said tension bands follows a path that extends along an outside of a left thigh region of the garment to a left hip region of the garment and inwardly from the left hip region across a left upper glute region of the garment towards a mid-line of the garment; and a second one of said tension bands follows a path that extends along an outside of a right thigh region of the garment to a right hip region of the garment and inwardly from the right hip region across a right upper glute region of the garment towards the mid-line of the garment.

6. The swimming garment according to claim 5, wherein, in use, the stretchable elasticated fabric is also configured to cover at least part of the wearer's abdomen, chest and back.

7. The swimming garment according to claim 6, wherein:

the path of the first tension band extends from the left upper glute region of the suit across a back of the suit and to a right rear shoulder region of the suit; and the path of the second tension band extends from the right upper glute region of the suit across the back of the suit and to a left rear shoulder region of the garment;

wherein the first and second tension bands cross one another at the mid-line of the suit in a lower back region of the suit.

8. The swimming garment according to claim 5, wherein the paths of the tension bands are such that when the garment is worn the first and second tension bands are configured to generally follow posterior oblique myofascial lines of the wearer.

9. The swimming garment according to claim 5, wherein the tension bands comprise seams in the garment.

10. The swimming garment according to claim 9, wherein the seams join separate panels of the stretchable elasticated fabric from which the garment is formed.

11. The swimming garment according to claim 9, wherein the seams are stitched seams.

12. The swimming garment according to claim 9, wherein the seams are bonded seams.

* * * * *